United States Patent [19]

Terauchi et al.

[11] Patent Number: 4,880,360

[45] Date of Patent: Nov. 14, 1989

[54] VARIABLE DISPLACEMENT COMPRESSOR WITH BIASED INCLINED MEMBER

[75] Inventors: Kiyoshi Terauchi, Gunma; Masaharu Hiraga, Saitama, both of Japan

[73] Assignee: Sanden Corporation, Gunma, Japan

[21] Appl. No.: 195,159

[22] Filed: May 18, 1988

[30] Foreign Application Priority Data

May 19, 1987 [JP] Japan ..... 62-73666[U]

[51] Int. Cl.[4] ..... F04B 1/26

[52] U.S. Cl. ..... 417/222; 417/269

[58] Field of Search ..... 417/222 S, 269, 270; 92/12.2; 74/60

[56] References Cited

U.S. PATENT DOCUMENTS

| | | | |
|---|---|---|---|
| 3,861,829 | 1/1975 | Roberts et al. . | |
| 4,037,993 | 7/1977 | Roberts . | |
| 4,145,163 | 3/1979 | Fogelberg et al. . | |
| 4,174,191 | 11/1979 | Roberts . | |
| 4,428,718 | 1/1984 | Skinner . | |
| 4,475,871 | 10/1984 | Roberts . | |
| 4,480,964 | 11/1984 | Skinner | 417/222 S |
| 4,506,648 | 3/1985 | Roberts . | |
| 4,533,299 | 8/1985 | Swain et al. . | |
| 4,543,043 | 9/1985 | Roberts . | |
| 4,586,874 | 5/1986 | Hiraga et al. . | |
| 4,632,640 | 12/1986 | Terauchi . | |
| 4,664,604 | 5/1987 | Terauchi | 417/222 S |
| 4,732,544 | 3/1988 | Kurosawa et al. . | |
| 4,780,060 | 10/1988 | Terauchi | 417/222 |

FOREIGN PATENT DOCUMENTS

| | | | |
|---|---|---|---|
| 1906226 | 10/1969 | Fed. Rep. of Germany . | |
| 585940 | 11/1958 | Italy . | |
| 60-162087 | 8/1985 | Japan . | |
| 55478 | 3/1987 | Japan | 417/222 S |
| 62-55478 | 3/1987 | Japan . | |
| 530595 | 12/1940 | United Kingdom . | |
| 865876 | 4/1961 | United Kingdom . | |
| 964000 | 7/1964 | United Kingdom . | |
| 1436390 | 5/1976 | United Kingdom . | |
| 2153922A | 1/1985 | United Kingdom . | |

*Primary Examiner*—William L. Freeh

*Attorney, Agent, or Firm*—Banner, Birch, McKie & Beckett

[57] ABSTRACT

A reciprocating piston type refrigerant compressor is disclosed. The compressor includes a housing having a cylinder block provided with a plurality of cylinders and a crank chamber adjacent the cylinder block. A piston slides within each cylinder and is reciprocated by a drive mechanism which includes a rotary drive shaft, a rotor mounted on the drive shaft, and a coupling mechanism which converts the rotary motion of the rotor into the reciprocating motion of the pistons. The coupling mechanism includes an inclined member which has an inclined surface disposed at an adjustable incline angle. Accordingly, the stroke of the pistons within the cylinders can be changed by adjusting the incline angle of the inclined surface in response to the change of pressure in the crank chamber. A spring applies a force to urge the inclined surface to a decreased incline angle when th incline angle is greater than a predetermined incline angle, but applies no force when the angle is less incline than the predetermined incline angle.

11 Claims, 4 Drawing Sheets

VARIABLE DISPLACEMENT COMPRESSOR WITH BIASED INCLINED MEMBER

TECHNICAL FIELD

The present inventio relates to a refrigerant compressor, and more particularly, to a slant plate type compressor, such as a wobble plate type compressor, with a variable displacement mechanism suitable for use in an automotive air conditioning system.

BACKGROUND OF THE INVENTION

It has been recognized that it is desirable to provide a slant plate type of compressor, such as a wobble plate type piston compressor, with a displacement or capacity adjusting mechanism to control a compression ratio in response to demand. In the wobble plate type piston compressor, control of the compression ratio can be accomplished by changing a slant or incline angle of a sloping surface of a slant plate to a drive shaft in response to crank chamber pressure which is controlled by a pressure control mechanism such as disclosed in U.S. Pat. No. 4,428,718 issued Jan. 31, 1984 to Timothy J. Skinner. In this wobble plate type piston compressor, the slant plate stops in any incline angle when the compressor is stopped, and also starts wobble motion in any angle when the compressor is started. The compressor can be seriously damaged when operated in this manner, particularly when the compressor is used in an automotive air conditioning system. For example, if rotation of the slant and wobble plates is initiated at a high speed by an engine of a vehicle through an electromagnetic clutch with the slant plate situated at the largest slant angle with respect to the longitudinal axis of the drive shaft, the complex components of the compressor, such as the variable displacement mechanism, a rotation-preventing mechanism of the wobble plate and seal elements which are disposed in a cylinder head receive a sudden and large shock. Furthermore, this shock is increased by operation of the compression of suction refrigerant gas including a large amount liquified refrigerant gas. As a result, these interior components of the compressor can be seriously damaged.

U.S. Pat. No. 4,543,043 issued Sept. 24, 1985 to Richard W. Roberts discloses the two types of devices to avoid the disadvantages of allowing the slant plate to stop in any position. One device is shown in FIG. 6 and another device is shown in FIG. 2 of the '043 U.S. patent.

The device illustrated in FIG. 6 uses a piston-stroke-decreasing bias spring mounted on a drive shaft. The spring is located between a rear surface of a thrust flange, i.e. the rotor, and a front surface of a hinge ball. The piston-stroke-decreasing bias spring provides a force tending to move a wobble plate-drive plate assembly, i.e., slant plate, mounted on the hinge ball toward a minimum piston stroke position. Such a prior art mechanism exhibits the following problems: the compressor always starts at a minimum piston stroke stage, because the piston-stroke-decreasing bias spring urges the wobble plate-drive plate assembly, including a stop pin, to the minimum slant angle. When the compressor is started at a minimum piston stroke stage, only minimal compression gas force is generated tending to increase the slant angle. In addition, an excessive compression gas force in the cylinder is needed to oppose the restoring force of the piston-stroke-decreasing bias spring. Therefore, it takes a relatively long time to obtain a proper slant angle in relation to the heat load of the compressor.

The device illustrated in FIG. 2 of the '043 patent includes both a piston-stroke-decreasing bias spring and a piston-stroke-increasing bias spring. The piston-stroke-decreasing bias spring is mounted on the drive shaft at a location between the rear surface of the thrust flange, i.e. the rotor, and the front surface of the hinge ball. The piston-stroke-increasing bias spring is mounted on the drive shaft at a location between a rear surface of the hinge ball and a cylinder block. The bias forces of two springs tend to move the hinge ball along the drive shaft in opposite directions. However, at an equilibrium balanced position, the hinge ball is positioned to provide a nominal stroke of about 0.100 inch to pistons. The two spring system overcomes the problems relating to above single spring device, by the use of the piston-stroke-increasing bias spring. However, other problems arise. For example, a complicated structure requiring a bias spring on both sides of the slant plate must be assembled. This complicated structure makes the step of compressor assembly more difficult and costly. Another problem, which occurs during displacement changes, is an unusual vibration of the slant plate at a natural frequency of the bias springs' applying forces in opposite directions on the slant plate.

Roberts '043 discloses a capacity adjusting mechanism used in a wobble plate type compressor. As is typical in this type of compressor, the wobble plate is disposed at a slant or incline angle relative to the drive axis, nutates but does not rotate, and drivingly couples the pistons to the drive source. This type of capacity adjusting mechanism, using selective fluid communication between the crank chamber and the suction chamber, however, can be used in any type of compressor which uses a slanted plate or slanted surface in the drive mechanism. For example, U.S. Pat. No. 4,664,604, issued to Terauchi, discloses this type of capacity adjusting mechanism in a swash plate type compressor. The swash plate, like the wobble plate, is disposed at a slant angle and drivingly couples the pistons to the drive source. However, while the wobble plate only nutates, the swash plate both nutates and rotates. The term slant plate type compressor will therefore be used herein to refer to any type of compressor, including wobble and swash plate types, which use a slanted plate or slanted surface in the drive mechanism.

SUMMARY OF THE INVENTION

In order to eliminate the above mentioned problems of slant plate type compressors with variable displacement mechanisms known in the prior art, it is a primary object of this invention to provide an improved refrigerant compressor wherein a bias spring is mounted on a drive shaft at a location between a cam rotor and an inclined member to urge a decreased incline angle only when the inclined surface of the inclined member is disposed at a predetermined incline angle, which is greater than the minimum incline angle of the inclined surface.

This object of the present invention is achieved by a refrigerant compressor which includes a housing having a cylinder block with a plurality of cylinders and a crank chamber adjacent the cylinder block. A piston is slidably disposed within each cylinder and is reciprocated by a drive mechanism. The drive mechanism includes a drive shaft rotatably supported in the housing, a drive rotor coupled to the drive shaft, and a coupling mechanism which couples the rotor to the pistons so that the rotary motion of the rotor is converted into reciprocating motion of the pistons. The coupling mechanism includes an inclined member having an inclined surface disposed at an incline angle relative to the drive shaft. The incline angle is adjustable between a maximum angle and a minimum angle in response to pressure changes in the crank chamber to vary the stroke length of the pistons and, thus, the capacity of the compressor. An elastic mechanism provides a force to urge the inclined surface of the inclined member toward a decreased incline angle. The elastic mechanism provides the force only when the inclined surface is disposed at an incline angle between the maximum incline angle and a predetermined incline angle, which is greater than the minimum incline angle. Thus, the elastic mechanism provides no force to the inclined member when the inclined surface is disposed at an angle less than the predetermined angle.

In a preferred embodiment, the elastic mechanism is a bias spring mounted on the drive shaft at a location between a rear end surface of the rotor and a front end surface of the slant member. A relaxed longitudinal length of the bias spring is less than the distance between the facing end surfaces of the rotor and the inclined member adjacent the drive shaft with the inclined surface at the minimum incline angle, and is also greater than the distance between the facing surfaces of the rotor and the inclined member with the inclined surface at the maximum incline angle.

In a refrigerant compressor of the present invention, when the compressor stops, the elastic mechanism assures that the inclined surface of the inclined member does not come to rest at the maximum incline angle. Damage which occurs in such a situation thus is prevented. Furthermore, no force is applied to place and hold the inclined surface at the minimum incline angle. An appropriate piston stroke is therefore quickly reached, since the inclined member does not have to work against a spring return force when the inclined member comes to rest with the inclined surface at the minimum incline angle up to the predetermined incline angle.

Further objects, features and other aspects of this invention will be understood from the following detailed description of preferred embodiments of the invention with reference to the annexed drawings.

DETAILED DESCRIPTION OF THE PREFERRED EMBODIMENTS

Figure 1:
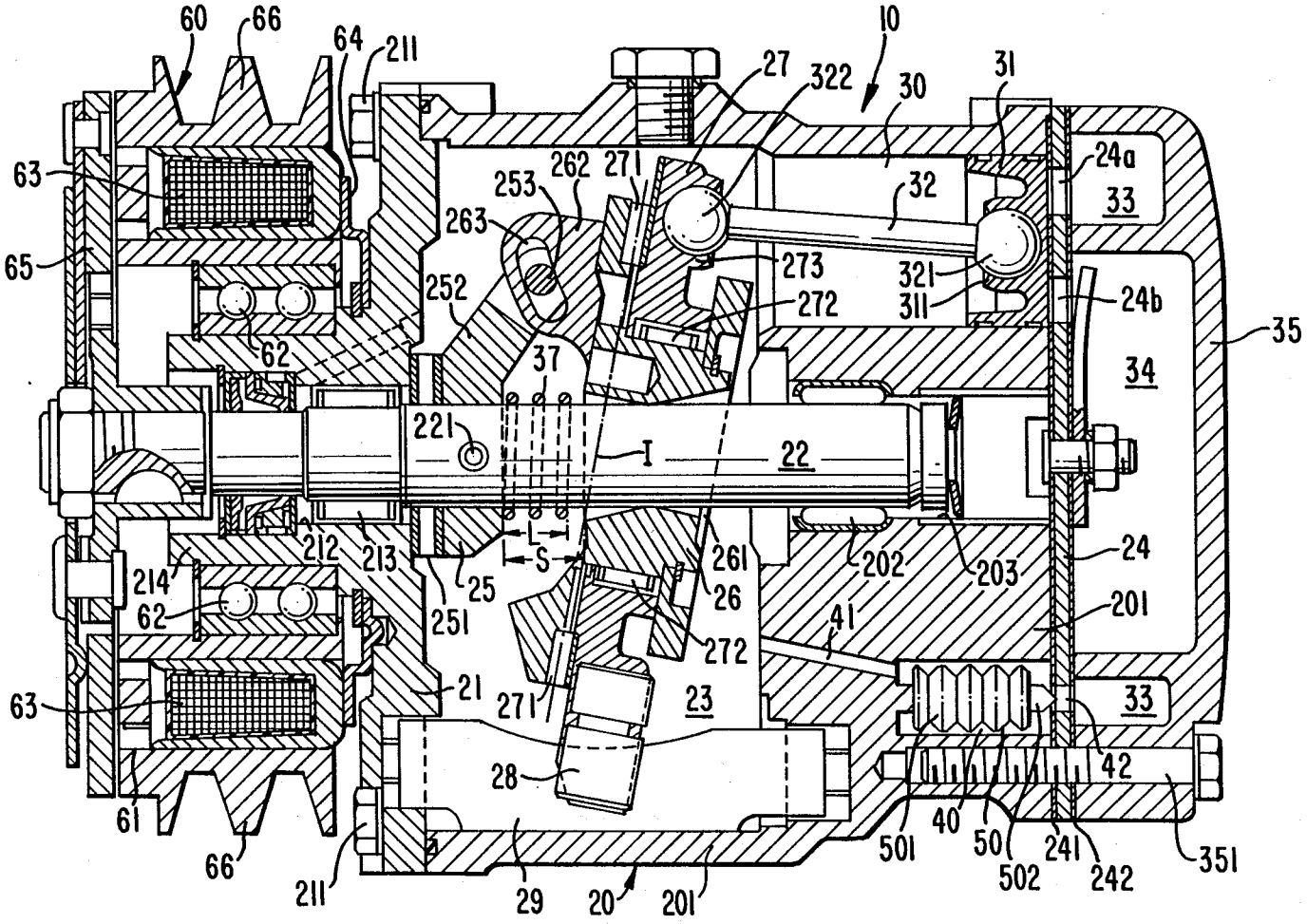
FIG. 1 is a vertical cross-sectional view of a refrigerant compressor according to one embodiment of the invention.

Referring to FIG. 1, a refrigerant compressor 10 in accordance with one embodiment of the present invention is shown. Compressor 10 includes a closed cylindrical housing assembly 20 formed by a cylinder block 201, a crank chamber 23 within cylinder block 201, a front end plate 21 and a rear end plate 35.

Front end plate 21 is mounted on a left end portion of crank chamber 23, as shown in FIG. 1, by a plurality of bolts 211. Rear end plate 35 and a valve plate 24 are mounted on cylinder block 201 by a plurality of bolts 351. An opening 212 is formed in front end plate 21 for receiving a drive shaft 22.

Drive shaft 22 is rotatably supported by front end plate 21 through a bearing 213 which is disposed within opening 212. The inner end portion of drive shaft 22 is also rotatably supported by cylinder block 201 through bearing 202 which is disposed within a central bore 203. Central bore 203 is a cavity formed in the center portion of cylinder block 201. A thrust needle bearing 251 is disposed between the inner end surface of front end plate 21 and the adjacent axial end surface of a cam rotor 25.

Cam rotor 25 is fixed on drive shaft 22 by a pin member 221 which penetrates cam rotor 25 and drive shaft 22. Cam rotor 25 is provided with an arm 252 having a pin 253. A slant plate 26 has an opening 261 through which passes drive shaft 22. Slant plate 26 includes an arm 262 having a slot 263 in which pin 253 is inserted. Cam rotor 25 and slant plate 26 are joined by the hinged joint of pin 253 and slot 263. Pin 253 is able to slide within slot 263 so that angular position of slant plate 26 can be changed with respect to the longitudinal axis of drive shaft 22 by moving slant plate 26 along the axis.

A wobble plate 27 is rotatably mounted on slant plate 26 through bearings 271 and 272. The rotation of wobble plate 27 is prevented by a fork-shaped slider 28 which is attached to the outer peripheral end of wobble plate 27 and is slidably mounted on sliding rail 29 held between front end plate 21 and cylinder block 201. In order to slide slider 28 on sliding rail 29, wobble plate 27 wobbles in a non-rotating manner in spite of the rotation of cam rotor 25.

Cylinder block 201 has a plurality of annularly arranged cylinders 30 in which respective pistons 31 slide. All pistons 31 are connected to wobble plate 27 by a corresponding plurality of connecting rods 32. A ball 321 at one end of rod 32 is received in a socket 311 of piston 31 and a ball 322 at the other end of rod 32 is received in a socket 273 of wobble plate 27. It should be understood that, although only one such ball socket connection is shown in the drawing, there are a plurality of sockets arranged peripherally around wobble plate 27 to receive the balls of various rods, and that each piston 31 is formed witha socket for receiving the other ball of rods 32.

Slant plate 26 and wobble plate 27 function together as an inclined member to couple cam rotor 25 to pistons 31 through piston rods 32 in such a manner that the rotation of rotor 25 is converted into reciprocating motion of pistons 31. To accomplish this function slant plate 26 has an inclined surface, illustrated as line I, disposed at an incline angle relative to the axis of drive shaft 22. This incline angle is adjustable by the sliding motion of slant plate 26 along drive shaft 22 with the resultant pivoting action of slant plate 26 as slot 263 moves about pin 253. The incline angle is adjustable between a minimum incline angle when slant plate 26 is moved furthest from rotor 25 and the upper portion of slot 263 contacts pin 253, and a maximum incline angle when slant plate 26 is closest to rotor 25 and the lowest portion of slot 263 contacts pin 253.

Rear end plate 35 is shaped to define a suction chamber 33 and a discharge chamber 34. Valve plate 24, which is fastened to the end of cylinder block 201 by screws 351 together with rear end plate 35, is provided with a plurality of valved suction ports 24a connected between suction chamber 33 and respective cylinders 30, and a plurality of valved discharge ports 24b connected between discharge chamber 34 and respective cylinders 30. Suitable reed valves for suction port 24a and discharge port 24b are described in U.S. Pat. No. 4,011,029 issued to Shimizu. Gaskets 241 and 242 are placed between cylinder block 201 and the inner surface of valve plate 24, and the outer surface of valve plate 24 and rear end plate 35, to seal mating surfaces of cylinder block 201, valve plate 24 and rear end plate 35.

An annular sleeve 214 projects from a front end surface of front end plate 21 to surround drive shaft 22 and define a shaft seal cavity. A clutch rotor 61 having a pulley 66 rotatably supported by a bearing 62 which is carried on the outer surface of sleeve 214. An electromagnetic coil 63 is fixed about the outer surface of sleeve 214 by support plate 64 and is received in an annular cavity of clutch rotor 61. An armature plate 65 is elastically supported on the outer end of drive shaft 22 which extends from sleeve 214. Clutch rotor 61, electromagnetic c oil 63 and armature plate 65 form a magnetic clutch 60.

A pressure sensitive chamber 40 in which a valve control mechanism 50 is disposed is formed in cylinder block 201. Valve control mechanism 50 incliudes a pressure sensing device 501 being longitudinally elastic in response to pressure, e.g., a bellows, and a valve 502 attached at one end of pressure sensing device 501. A communicating hole 41 is also formed in cylinder block 201 to communicate between crank chamber 23 and pressure sensitive chamber 40. Another communicating hole 42 which faces valve 502 is formed through valve plate 24 to communicate between pressure sensitive chamber 40 and suction chamber 33. Therefore, pressure sensing device 501 acts in a longitudinally elastic manner in response to crank chamber pressure fed through communicating hole 41. As a result, valve 502 opens and shuts communicating hole 42 in response to the operation of pressure sensing device 501. Accordingly, the flow of refrigerant gas from crank chamber 23 to suction chamber 33 via communicating hole 41, pressure sensitive chamber 40 and communicating hole 42 is controlled by valve control mechanism 50 in response to crank chamber pressure.

In operation of the refrigerant compressor, drive shaft 22 is rotated by external power source, for example the engine of an automobile, through a rotation transmitting device such as electromagnetic clutch 60. Cam rotor 25 and slant plate 26 joined by the hinged joint are rotated together with drive shaft 22 to cause a non-rotating wobbling motion of wobble plate 27. Rotating motion of wobble plate 27 is prevented by fork-shaped slider 28 which is attached to the outer peripheral end of wobble plate 27 and is slidably mounted on sliding rail 29 held between front end plate 21 and cylinder block 201. As wobble plate 27 moves, pistons 31 reciprocate out of phase in their respective cylinders 30. Upon reciprocation of pistons 31, the refrigerant gas, which is introduced into suction chamber 33 from a fluid inlet port (not shown) is taken into each cylinder 30 through suction port 24a and compressed. The compressed refrigerant gas is discharged to discharge chamber 34 from each cylinder 30 through discharge port 24b, and therefrom into an external fluid circuit, for example, a cooling circuit, through a fluid outlet port (not shown).

The stroke length of pistons 30 and hence, the capacity of compressor 10 is adjusted in the following manner. When the pressure of crank chamber 23 rises over a predetermined pressure, pressure sensing device 501 is compressed and valve 502 opens hole 42. Simultaneously, crank chamber 23 communicates with suction chamber 33 through hole 41, pressure sensitive chamber 40 and hole 42. Accordingly, the pressure of crank chamber 23 falls to the pressure of suction chamber 33. In this condition, wobble plate 27 usually is urged toward slant plate 26 during the compression stroke of piston 33 so that slant plate 26 moves toward rotor 25. Thus, the incline angle of slant plate 26 is maximized relative to the longitudinal axis of drive shaft 22 through the hinged joint of pin 253 and slot 263, i.e., stroke of pistons 31 within cylinders 30 is maximized.

However, falling pressure of crank chamber 23 makes pressure sensing device 501 expand to close hole 42 with valve 502. As a result, the pressure within crank chamber 23 gradually rises because blow-by gas, which leaks from cylinders 30 to crank chamber 23 through a gap between pistons 31 and cylinders 30 through the compressor stroke is contained in crank chamber 23. In this condition, the incline angle of slant plate 26 gradually decreases until it approaches nearly zero, i.e., slant plate 26 would be nearly perpendicular to drive shaft 22. As the incline angle of slant plate 26 decreases, the stroke of pistons 31 in cylinders 30 is reduced and the capacity of the compressor gradually decreases.

Figure 2:
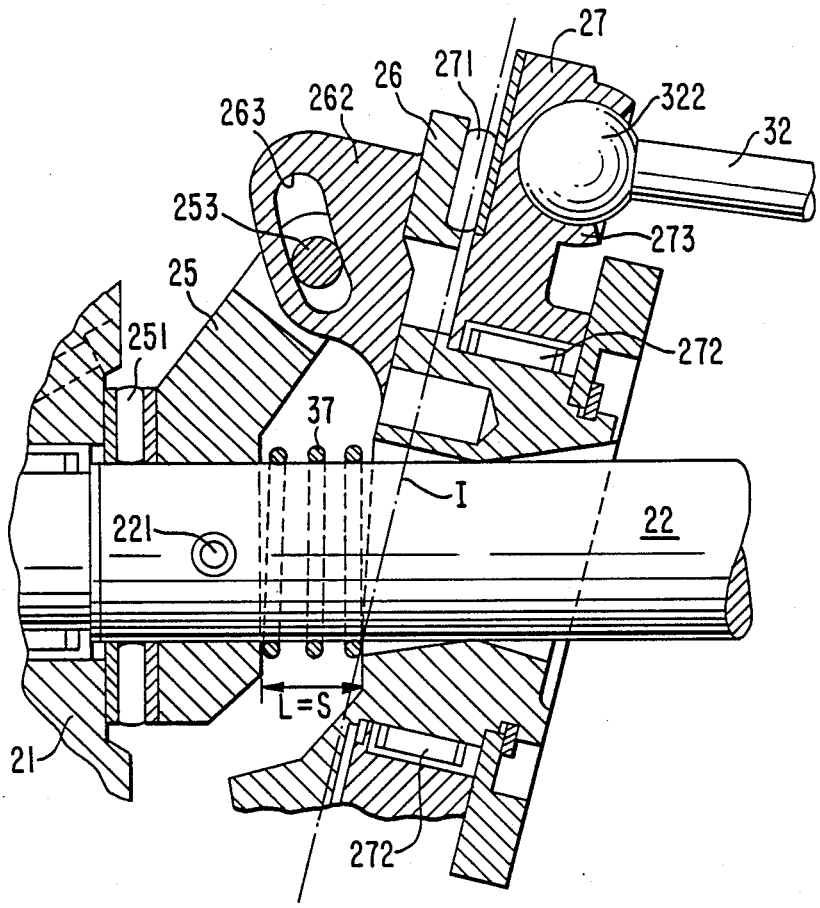
FIGS. 2 and 2a are a vertical cross-sectional views of the drive mechanism illustrated in FIG. 1 with the inclined member at the predetermined angle, and with FIG. 2a illustrating a shortened and repositioned bias spring.

An elastic mechanism, in the form of a coil spring 37, illustrated in FIGS. 1 and 2, provides an urging force on slant plate 26 to assure that slant plate 26 is urged away from the maximum incline angle when compressor 10 is stopped. Spring 37 has a relaxed longitudinal length L. Length L, as shon in FIG. 2, is equal to the distance between a front surface of slant plate 26 and a rear surface of rotor 25, which are adjacent to drive shaft 22 at the predetermined incline angle of incline surface I illustrated in FIG. 2. The predetermined incline angle is selected to be less than the maximum incline angle and greater than the minimum incline angle. With the predetermined angle and length L selected in this manner, spring 37 provides an elastic force on slant plate 26 to urge slant plate 26 toward a decreased inclined angle when the incline angle of slant plate 26 is between the predetermined incline angle and the maximum incline angle. However, when the incline angle of slant plate 26 is less than the predetermined incline angle, no force is applied by spring 37 to slant plate 26 since its length is less than the space between the facing surfaces of rotor 25 and slant plate 26 which are adjacent to drive shaft 22. In this manner, spring 37 assures that slant plate 26 does not come to rest at the maximum incline angle, while not providing a force which urges and holds slant plate 26 at the minimum incline angle.

Spring 37 is preferably held in a position with one end of spring 37 against the rear surface of cam rotor 25 which is adjacent to drive shaft 22, by forming spring 37 with an inner diameter slightly less than the outer diameter of drive shaft 22.

Figure 3:
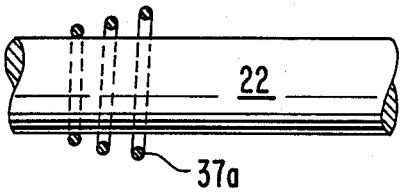
FIG. 3 is a partly sectional schematic illustrating of the drive shaft and spring according to another embodiment of this invention.

FIG. 3 illustrates an alternate embodiment of the present invention, wherein a spring 37a, having a relaxed length L, is secured about drive shaft 22. Spring 37*a* has a gradually increasing diameter proceeding from rotor 25 toward slant plate 26. Spring 37*a* thus takes on a configuration of a conch shell, i.e. an increasing diameter spiral. Spring 37*a* can be secured in position by having its smallest inner diameter less than the outer diameter of drive shaft 22.

Figure 2A:
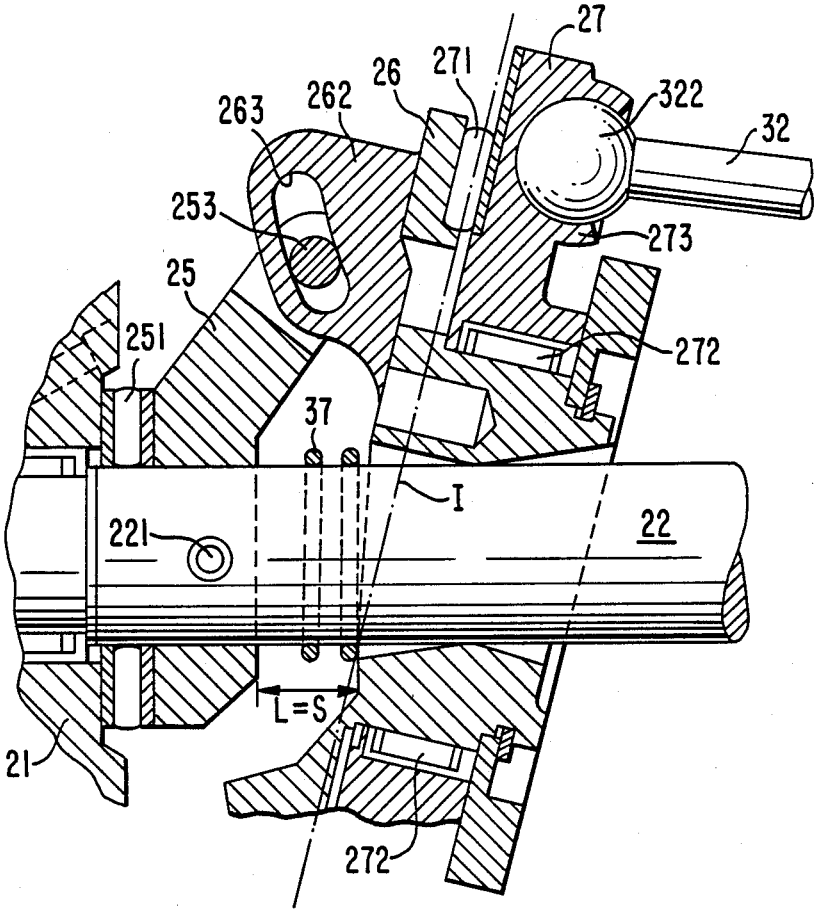

Alternatively, spring 37 or 37*a* can be secured to drive shaft 22 with its end spaced from the rear surface of rotor 25. In this situation, L is the spacing from the rear surface of rotor 25 to the end of the spring which comes into contact with the front surface of slant plate 26 at the predetermined angle of the inclined surface I. The length of the spring is therefore less than L. This alternative is shown in FIG. 2*a* with regard to spring 37.

Figure 4:
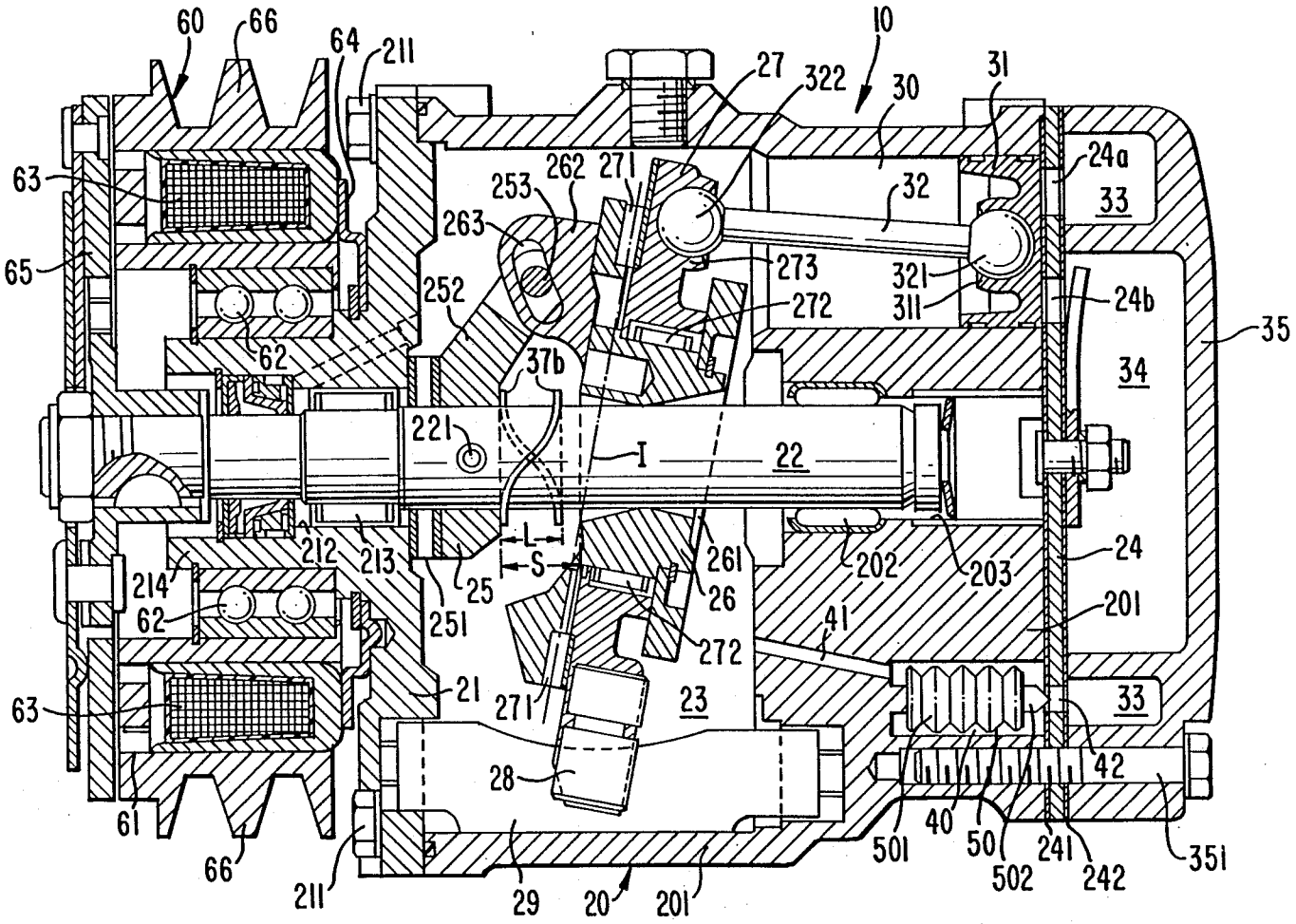
FIG. 4 is a view similar to FIG. 1 illustrating another embodiment of the invention.

FIG. 4 illustrates a further embodiment of the present invention, utilizing a leaf spring 37*b* in place of the coil springs of the first two embodiments. Leaf spring 37*b* is preferably welded to cam rotor 25 and has a relaxed length L.

In summary, the reference distance between rotor 25 and slant 26 adjacent to drive shaft 22 is the shortest distance, illustrated as S in the drawings, that exists between a rear end surface of cam rotor 25 and a front end surface of slant plate 26 along drive shaft 22. This shortest distance S changes as the incline angle of slant plate 26 changes. If slant plate 26 is located at the maximum incline angle, i.e., the largest compression ratio of the refrigerant compressor, the variable shortest distance S reaches its smallest value Smin. If slant plate 26 is located at the minimum incline angle, i.e., the smallest compression ratio of the refrigerant compressor, the variable shortest distance S reaches its largest value Smax. Accordingly, relaxed longitudinal length L is smaller than Smax, but larger than Smin. This relationship is shown in the following formula:

$$S_{min} < L < S_{max}$$

As the compression ratio of the refrigerant compressor is increasing toward the largest compression ratio, as described above, the incline angle of slant plate 26 increases and the variable distance S decreases toward S min. When S becomes less than L, slant plate 26 begins to compress spring 37 and spring 37 produces an increasing restoring force on slant plate 26 as S continued to decrease. Thus, a maximum restoring force is supplied by spring 37 at S min. Conversely, as the compression ratio of the referigerant compressor is decreasing, the incline angle of slant plate 26 decreases and the variant distance S increases toward Smax. As S increases from Smin, bias spring 37 produces a decreasing restoring force on slant plate 26. Furthermore, when S becomes greater than L, slant plate 26 is free from the restoring force of bias spring 37.

Therefore, when the compressor is stopped in the situation where the shortest distance S is smaller than the length L of bias spring 37, i.e., none or only a small amount of reduced displacement, slant plate 26 is moved toward the opposite side of rotor 25 by the restoring force of bias spring 37 to keep slant plate 26 away from the non reduced displacement stage.

In this preferred embodiment, the elastic mechanism is a bias spring, either a coil type or a leaf type; however, any type of elastic material can be used.

The present invention has been described in accordance with preferred embodiments. These embodiments, however, are merely for example only, and the invention should not be construed as limited thereto. It should be apparent to those skilled in the art that other variations or modifications can be made within the scope of this invention.

We claim:

1. In a refrigerant compressor including a compressor housing having a central portion, a front end plate at one end and a rear end plate at its other end, said housing having a cylinder block provided with a plurality of cylinders and a crank chamber within said cylinder block, a piston slidably fitted within each of said cylinders and reciprocated by a drive mechanism including a drive shaft rotatably supported in said housing, an input drive rotor coupled to said drive shaft and rotatable therewith, and coupling means for drivingly coupling said rotor to said pistons such that the rotary motion of said rotor is converted into reciprocating motion of said pistons, said coupling means including an inclined member having an inclined surface disposed at an incline angle relative to said drive shaft, said incline angle of said inclined member being adjustable between a maximum angle and a minimum angle in response to pressure changes in said crank chamber to vary the stroke length of said pistons and the capacity of the compressor, said rear end plate having a suction chamber and a discharge chamber, pressure control means for controlling pressure of said crank chamber, the improvement comprising:

elastic means for applying a force urging said inclined surface of said inclined member toward a decreased incline angle, said elastic means applying said force to said inclined member only when said inclined surface is positioned at an incline angle between its maximum incline angle and a predetermined incline angle, said predetermined incline angle being greater than said minimum incline angle whereby said elastic means apply no force to decrease the incline angle of said inclined surface when said inclined surface is positioned at an incline angle less than said predetermined incline angle.

2. The refrigerant compressor of claim 1 wherein said elastic means is positioned between said rotor and said inclined member.

3. The refrigerant compressor of claim 1 wherein said elastic means includes a spring which secured in position along an outer peripheral surface of said drive shaft at a location between said rotor and said inclined member.

4. The refrigerant compressor of claim 3 wherein said spring has an inner diameter slightly smaller than an outer diameter of said drive shaft.

5. The refrigerant compressor of claim 3 wherein said spring has a relaxed longitudinal length which is less than the distance between the facing surfaces of said rotor and inclined member adjacent said drive shaft with said inclined surface at said minimum incline angle, and which is greater than the distance between the facing surface of said rotor and inclined member with said inclined surface at said maximum incline angle.

6. The refrigerant compressor of claim 3 wherein said spring has a relaxed longitudinal length which is less than the distance between the facing surfaces of said rotor and inclined member adjacent said drive shaft with said inclined surface at said minimum incline angle, said spring having a first end adjacent to and spaced from said facing surface of said rotor and a second end, said second end in the relaxed position of said spring being located at an area to contact said facing surface of said inclined member when said inclined surface of said inclined member is at an incline angle equal to or greater than said predetermined incline angle.

7. The refrigerant compressor of claim 5 or 6 wherein said spring is fixed at a location along the length of said drive shaft so that the surface of said inclined member adjacent to said drive shaft is out of contact with said spring when the incline angle of said inclined member is less than said predetermined incline angle.

8. The refrigerant compressor of claim 1 wherein said elastic means is a leaf spring.

9. The refrigerant compressor of claim 1 wherein said elastic means is a coil spring.

10. The refrigerant compressor of claim 9 wherein said spring has an increasing diameter expanding in the direction toward said inclined member.

11. The refrigerant compressor of claim 9 or 10 wherein a portion of said spring adjacent said rotor has an inner diameter slightly smaller than the outer diameter of said drive shaft.

* * * * *